US011026524B2

(12) United States Patent
Zussman et al.

(10) Patent No.: US 11,026,524 B2
(45) Date of Patent: Jun. 8, 2021

(54) ACCESSORY SHELF RAIL SYSTEM

(71) Applicant: PLASTICS PLUS, INC., Cumberland, RI (US)

(72) Inventors: Daniel Zussman, Cumberland, RI (US); Christopher Brooks, Cumberland, RI (US)

(73) Assignee: PLASTICS PLUS, INC., Cumberland, RI (US)

( * ) Notice: Subject to any disclaimer, the term of this patent is extended or adjusted under 35 U.S.C. 154(b) by 0 days.

(21) Appl. No.: 16/705,928

(22) Filed: Dec. 6, 2019

(65) Prior Publication Data

US 2020/0113354 A1 Apr. 16, 2020

Related U.S. Application Data

(63) Continuation of application No. 16/052,360, filed on Aug. 1, 2018, now Pat. No. 10,499,753.

(51) Int. Cl.

| | |
|---|---|
| ***A47F 5/00*** | (2006.01) |
| ***A47F 1/12*** | (2006.01) |
| ***G09F 7/18*** | (2006.01) |
| ***G09F 3/20*** | (2006.01) |

(52) U.S. Cl.

CPC ..... *A47F 5/0068* (2013.01); *A47F 1/125* (2013.01); *G09F 3/204* (2013.01); *G09F 7/18* (2013.01); *G09F 2007/1856* (2013.01)

(58) Field of Classification Search

CPC ..... A47F 5/0068; A47F 1/125; F16B 2/22; G09F 3/204; G09F 7/18; G09F 2007/1856; G09F 3/16; F16M 13/022

See application file for complete search history.

(56) References Cited

U.S. PATENT DOCUMENTS

| | | | | |
|---|---|---|---|---|
| 3,647,078 | A | 3/1972 | Fortunato | |
| 3,889,408 | A | 6/1975 | Offner | |
| 4,373,448 | A * | 2/1983 | Pallotta | A47B 96/021 108/29 |
| 4,426,797 | A | 1/1984 | Burkemper et al. | |
| 4,688,341 | A | 8/1987 | Castel | |
| 5,044,104 | A | 9/1991 | Hopperdietzel | |
| 5,088,607 | A * | 2/1992 | Risafi | A47B 57/42 211/187 |
| 5,232,104 | A | 8/1993 | Francois | |
| 5,341,945 | A | 8/1994 | Gibson | |
| 6,026,603 | A | 2/2000 | Kump et al. | |
| 6,041,720 | A | 3/2000 | Hardy | |
| 6,082,687 | A | 7/2000 | Kump et al. | |
| 6,289,618 | B1 | 9/2001 | Kump et al. | |
| 6,332,547 | B1 * | 12/2001 | Shaw | A47F 1/12 211/59.2 |

(Continued)

*Primary Examiner* — Ko H Chan

(74) *Attorney, Agent, or Firm* — Adler Pollock & Sheehan P.C.

(57) ABSTRACT

An accessory shelf rail system includes a generally planar top portion, a generally planar front portion, a lower portion of the front portion angled inwardly, a rear portion of the top portion including a top channel and a lip forming a lip channel, the top channel and the lip channel are contained in an entire length of the top portion, and a step-shaped securing bracket slidably positioned in the lip channel, the step-shaped securing bracket configured to removably attach the top portion to a horizontal retail shelf.

19 Claims, 4 Drawing Sheets

(56) References Cited

U.S. PATENT DOCUMENTS

| | | | | |
|---|---|---|---|---|
| 6,481,133 | B1 * | 11/2002 | DeSena | G09F 3/204 40/649 |
| 6,655,536 | B2 | 12/2003 | Jo et al. | |
| 6,935,062 | B2 | 8/2005 | Lowry et al. | |
| 6,964,235 | B2 | 11/2005 | Hardy | |
| 8,333,285 | B2 | 12/2012 | Kiehnau et al. | |
| 8,793,913 | B1 | 8/2014 | Zobel et al. | |
| 8,857,087 | B1 | 10/2014 | Wildrick et al. | |
| 10,181,273 | B2 * | 1/2019 | Norman | G09F 3/204 |
| 2003/0098400 | A1 | 5/2003 | Fast et al. | |
| 2004/0237369 | A1 * | 12/2004 | Andersson | G09F 3/204 40/661.03 |
| 2006/0011794 | A1 * | 1/2006 | Zadak | A47F 5/0884 248/220.31 |
| 2006/0053670 | A1 | 3/2006 | Wiltfang et al. | |
| 2007/0044361 | A1 * | 3/2007 | Gormley | G09F 3/204 40/661.03 |
| 2008/0295373 | A1 | 12/2008 | Garfinkle | |
| 2009/0321595 | A1 | 12/2009 | Conway et al. | |
| 2010/0205841 | A1 * | 8/2010 | Stancer, III | G09F 15/0012 40/607.14 |

* cited by examiner

ACCESSORY SHELF RAIL SYSTEM

STATEMENT REGARDING GOVERNMENT INTEREST

None.

CROSS REFERENCE TO RELATED APPLICATIONS

None.

BACKGROUND OF THE INVENTION

The invention generally relates retail shelves, and more specifically to an accessory shelf rail system.

In general, where metal shelving is used to display goods in retail stores, it is usually required to provide a means for displaying price and other information relating to the products on display. One way that this has been accomplished is by providing labels that attach to a flat outside edge of the shelf by means of double-sided tape.

Other implementations include providing a shelf with a C-shaped channel formed from an extension of an upper surface of the shelf, bent to form a channel and spot-welded to the exposed outer edge of the shelf. Where a channel is provided, a card or label may be retained directly within the channel.

Still other implementations provide a clear covering or holder for labels to eliminate a need to tape labels directly to shelves and protect the labels from tampering. The simplest of these is a simple plastic panel that is removably inserted into the C-channel, typically by sliding the panel into the channel from its end.

What is needed is a simple system of flexibly positioned components for organization and messaging on retail shelves.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In general, in one aspect, the invention features a shelf system including a retail shelf, the retail shelf including a generally planar surface having rear facing portion and a front facing portion, the planar surface including a series of apertures, and an accessory shelf rail system removably secured to the front portion of the retail shelf with at least one step-shaped securing bracket.

In another aspect, the invention features an accessory shelf rail system including a generally planar top portion, a generally planar front portion, a lower portion of the front portion angled inwardly, a rear portion of the top portion including a top channel and a lip forming a lip channel, the top channel and the lip channel are contained in an entire length of the top portion, and a step-shaped securing bracket slidably positioned in the lip channel, the step-shaped securing bracket configured to removably attach the top portion to a horizontal retail shelf.

In still another aspect, the invention features a method including providing a retail shelf, the retail shelf including a generally planar surface having rear facing portion and a front facing portion, the planar surface including a series of apertures, and providing an accessory shelf rail system removably secured to the front portion of the retail shelf with at least one step-shaped securing bracket.

Embodiments of the invention may have one or more of the following advantages.

Merchandise sales increase when products are well organized, easily identifiable and accompanied by relevant features and benefits information. The present invention provides a system of flexibly positioned components for organization and messaging on retail shelves.

The present invention features a shelf rail capable of supporting product dividers and messaging components.

Additional components in the system of the present invention expand the messaging capabilities with messaging frames that affix to a shelf without interference from and/or to a shelf rail.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
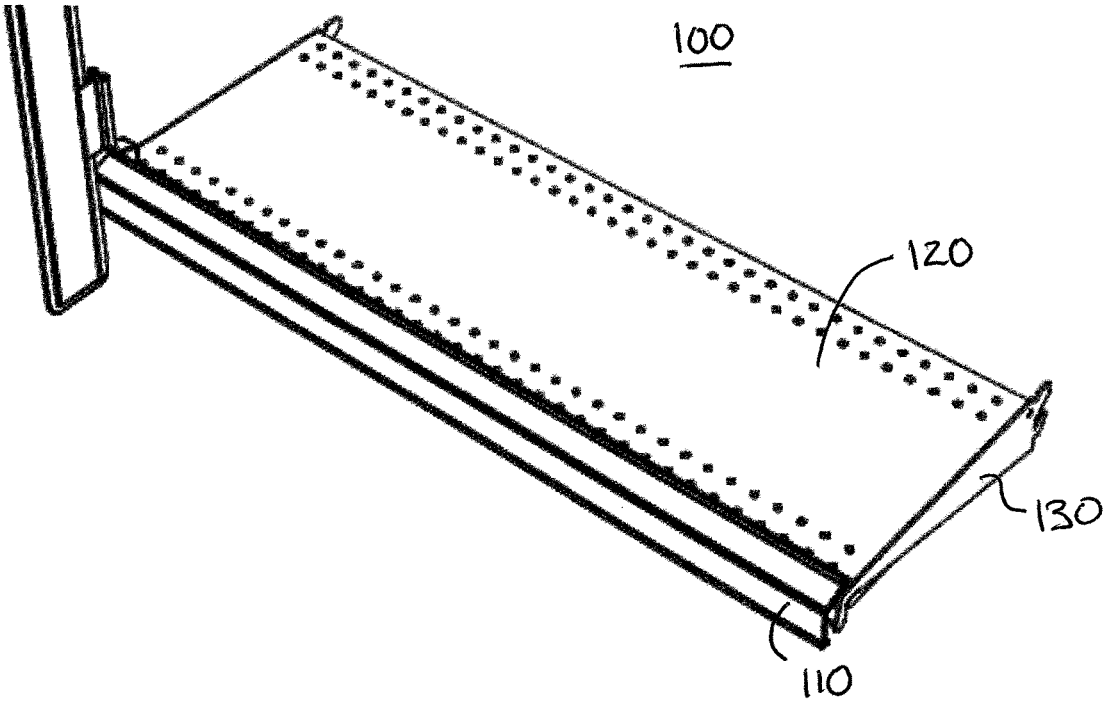
FIG. 1 is a block diagram of an exemplary shelf system.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As shown in FIG. 1, an exemplary shelf system 100 includes an accessory shelf rail system 110 secured to a front portion of a standard retail shelf 120. In this implementation, the shelf 120 is suspended horizontally with respect to the ground by a shelf bracket 130. Although only a single shelf bracket 130 is shown, it should be appreciated that the shelf 120 is generally supported by two or more shelf brackets. Moreover, a length of the accessory shelf rail system 110 is matched to a length of the shelf 120. In other embodiments, the length of the accessory shelf rail system 110 may vary. Spaced apart on the shelf 120 are number of apertures 140.

Figure 2:
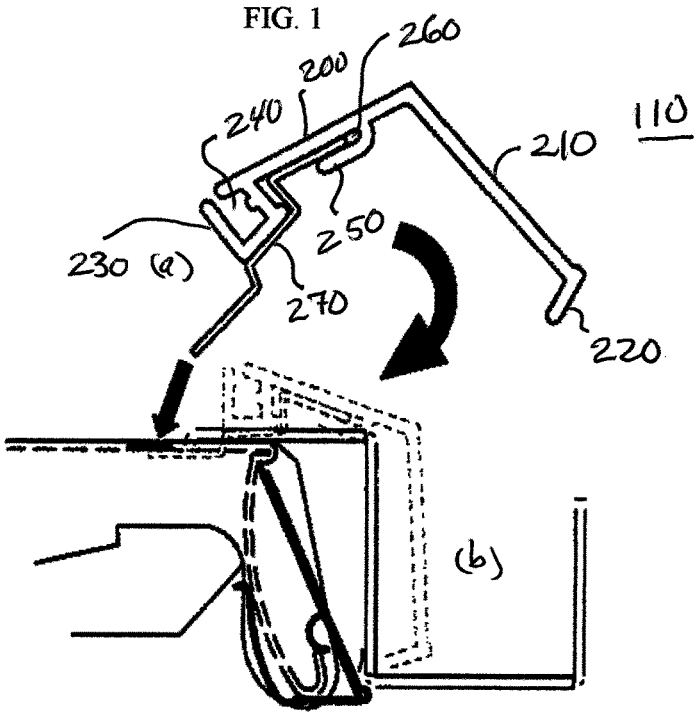
FIG. 2 is a block diagram of a side view of an exemplary accessory shelf rail system.

In FIG. 2, a side view of the exemplary accessory shelf rail system 110 is illustrated (a) before secured to the shelf 120 and (b) secured to the shelf 120. The accessory shelf rail system 110 includes a generally planar top portion 200 and a generally planar front portion 210. In the embodiment illustrated, a lower portion 220 of the front portion 210 is angled inwardly.

A rear portion 230 of the top portion 200 includes a top channel 240 and a lip 250 forming a lip channel 260. Both the top channel 240 and the lip channel 260 are contained in the entire length of the top portion 200. A step-shaped securing bracket 270, described below, is positioned as needed in the lip channel 260 to removably attach the accessory shelf rail system 110 to shelf 120.

In the embodiment shown of the exemplary accessory shelf rail system 110, it is manufactured by extrusion as a one piece system.

Figure 3:
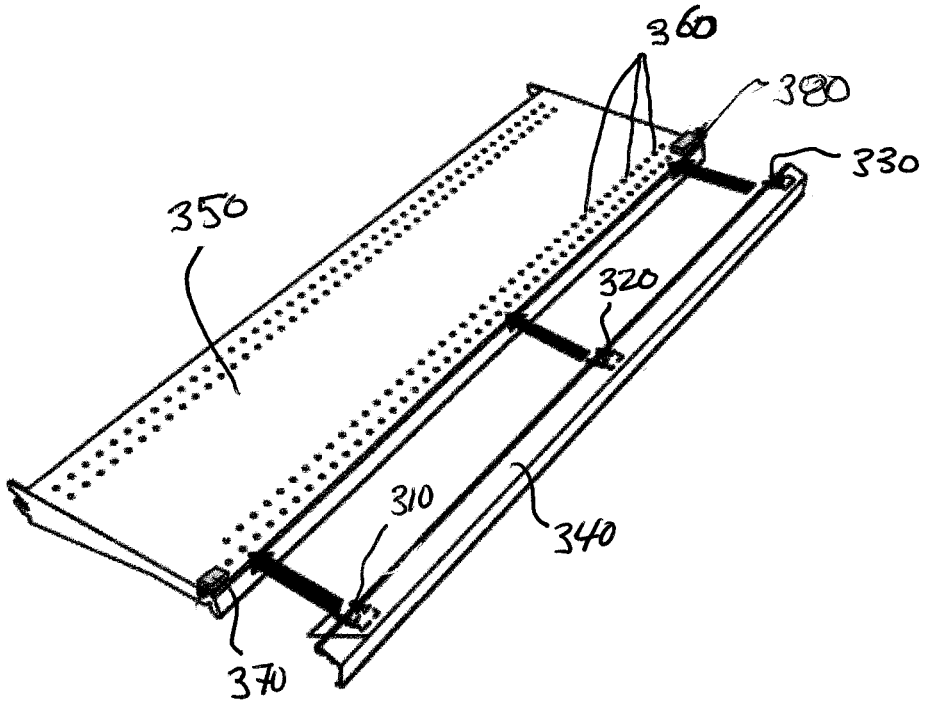
FIG. 3 illustrates multiple securing brackets.

In FIG. 3, three securing brackets 310, 320, 330 are shown that are used to secure the accessory shelf rail system 340 to the shelf 350. As described above, the number of securing brackets can vary. In addition, the each of the securing brackets 310, 320, 330 is configured to slide in the lip channel (not shown) to enable proper alignment to corresponding apertures 360 in the shelf 350.

Also shown are optional endcaps 370, 380, which may be added to prevent the accessory shelf rail system 340 from unintentional sliding along the shelf 350.

Figure 4:
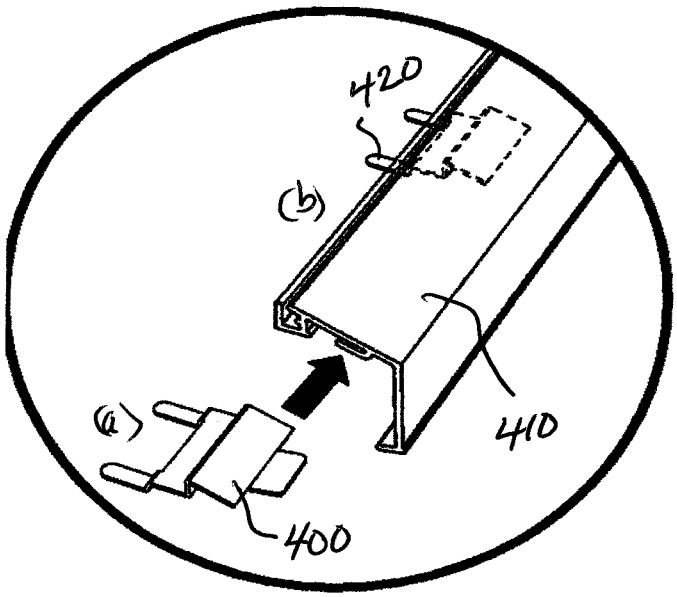
FIG. 4 is a perspective view of a securing bracket.

In FIG. 4, a perspective view illustrates a securing bracket 410 (*a*) positioned separate from an accessory shelf rail system 410 and a securing bracket 420 (*b*) positioned within a lip channel of the accessory shelf rail system 410.

Figure 5:
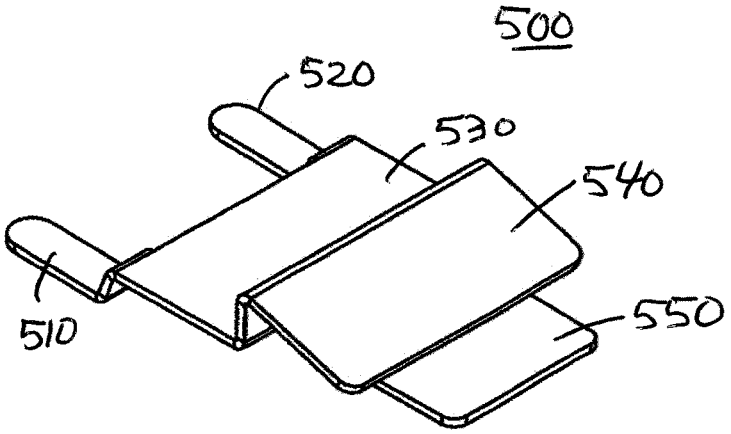
FIG. 5 illustrates an exemplary securing bracket.

As shown in FIG. 5, an exemplary securing bracket 500 includes two prongs 510, 520 offset from a flat stabilizing portion 530, which is offset from an upper channel member 540 and a lower channel member 550. The two prongs 510, 520 are configured to mate with correspondingly apertures in a shelf. The upper channel member 540 and the lower channel member 550 are configured to engage above and below a lip channel, described above. In a preferred embodiment, the securing bracket 500 is constructed of metal.

Figure 6:
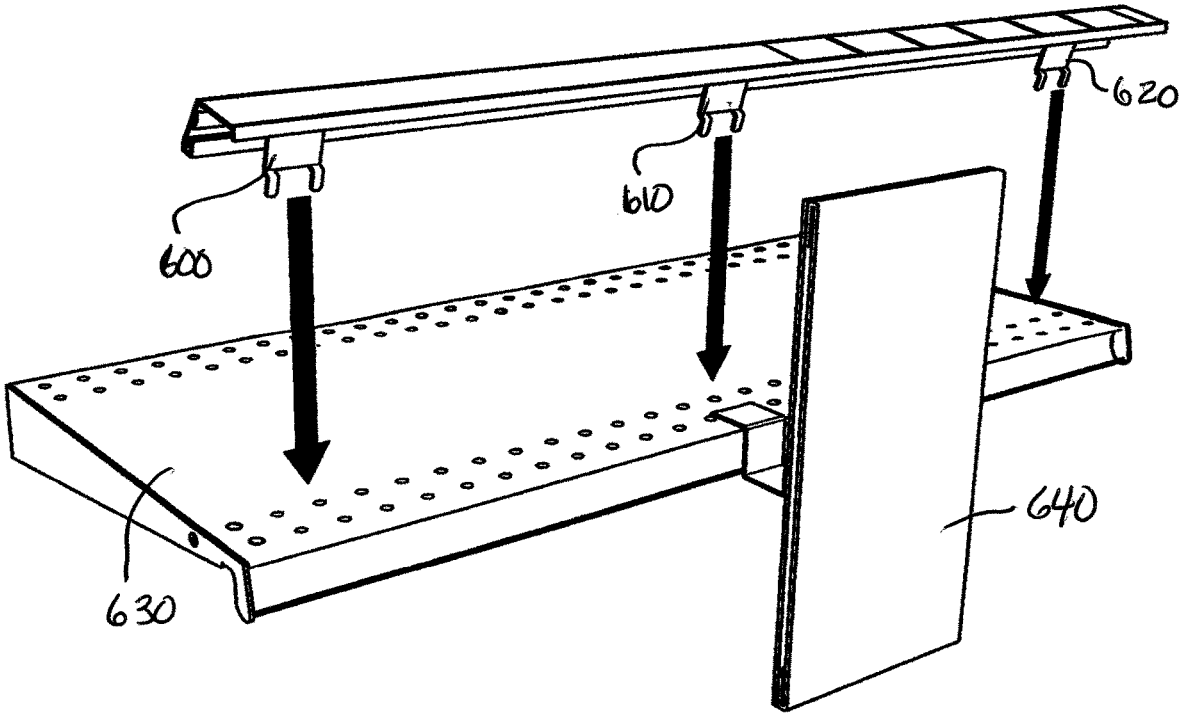
FIG. 6 illustrates prongs of securing brackets.

In FIG. 6, twin prongs contained on each of the three securing brackets 600, 610, 620 are shown positioned for placement in corresponding apertures of the shelf 630. Also shown is an optional display mount 640. The display mount 640 may be secured to the shelf 630 with a bracket as described above and used to display information on an outward facing side in greater size and/or detail, such as signage. In one embodiment, the securing brackets 600, 610, 620 are hinged to enable lifting of the accessory shelf rail system up so that the display mount 640 may be secured to the shelf 630 before the accessory shelf rail system is closed down. More specifically, the prongs may be secured to the flat stabilizing portion with a hinge mechanism.

Figure 7:
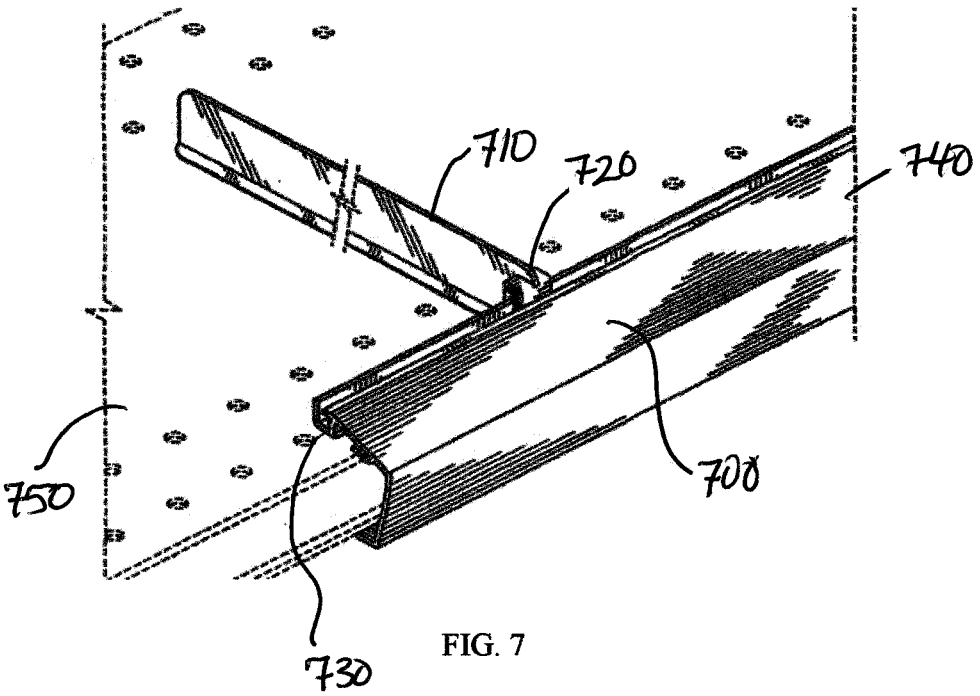
FIG. 7 illustrates an accessory shelf rail system including a rail.

As shown in FIG. 7, an accessory shelf rail system 700 includes a rail 710. A front portion 720 of the rail 710 is configured to slide within a top channel 730 of the accessory shelf rail system 700. Here the rail 710 is positioned ninety degrees relative to a top portion 740 of the accessory shelf rail system 700. In embodiments, multiple rails are used to contain and separate items positioned on the shelf 750. In still other embodiments, other fixtures may be adapted to slide within the top channel 730.

Figure 8:
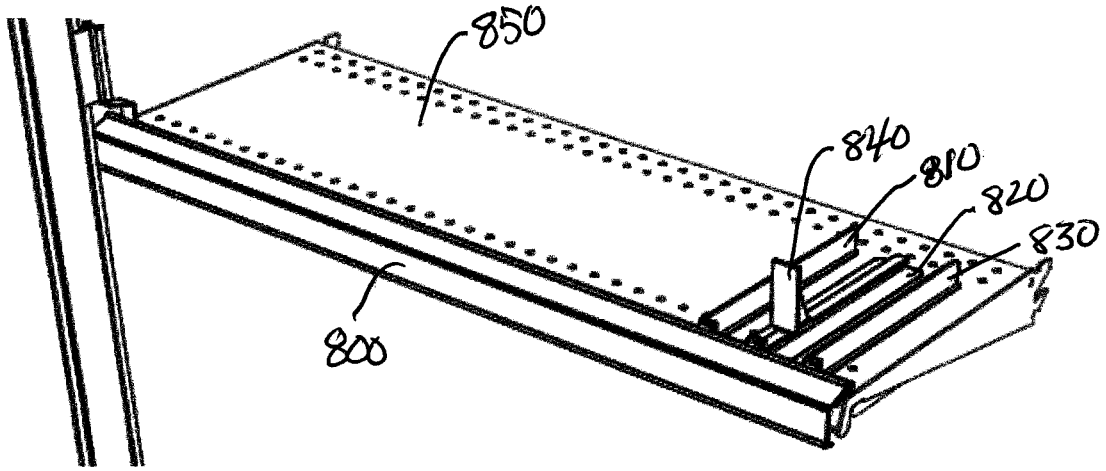
FIG. 8 illustrates an accessory shelf rail system including a rail having a slide accessory.

As shown in FIG. 8, an accessory shelf rail system 800 includes multiple rails 810, 820, 830. Rail 820 is configured flat and includes a slide accessory 840 configured to attach to and slide back and forth along a length of the rail 820. This slide accessory 840, for example, can be used to manage retail items placed on the shelf 850. The slide accessory 840 is moved to a rearward position, distant from the accessory shelf rail system 800, and the shelf populated with retail items. As the inventory of retail items are consumed near the accessory shelf rail system 800, the slide accessory 840 can manually be moved toward the accessory shelf rail system 800, pushing the remaining inventory of retail items towards the accessory shelf rail system 800 for easier consumer consumption.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A shelf system comprising:

a retail shelf, the retail shelf comprising a generally planar top surface having a rear facing portion and a front facing portion, the generally planar top surface comprising a series of spaced apertures; and an accessory shelf rail system removably secured to the front facing portion of the retail shelf with at least one step-shaped securing bracket, the accessory shelf rail system comprising a generally planar top portion having a top side and an opposed lower side, a lip extending below the lower side of the top portion and defining, together with the lower side of the top portion, a lip channel that is between the lip and the lower side of the top portion and is parallel to the top portion;

the at least one step-shaped securing bracket comprising a planar upper channel member that is constructed and arranged to fit into and slidably engage in the lip channel in a plane parallel to the top portion, the step-shaped securing bracket configured to removably attach to the retail shelf with a plurality of separate spaced prongs that are constructed and arranged to fit into separate spaced apertures of the generally planar top surface of the retail shelf, to place the upper channel member above the top side of the top surface of the retail shelf.

2. The shelf system of claim 1 wherein the accessory shelf rail system further comprises:

a generally planar front portion connected to the top portion, and a lower portion connected to the front portion and angled inwardly; and a rear portion of the top portion comprising a top channel and a lip forming a lip channel, the top channel and the lip channel extending along an entire length of the top portion.

3. The shelf system of claim 2 wherein the at least one step-shaped securing bracket comprises two prongs offset from a flat stabilizing portion, and wherein the flat stabilizing portion is offset from the upper channel member, wherein the bracket further comprises a lower channel member that is configured to sit directly under and engage the top channel.

4. The shelf system of claim 3 wherein the flat stabilizing portion is attached to the upper channel member with a hinge.

5. The shelf system of claim 2 wherein the accessory shelf rail system further comprises a bar positioned ninety degrees from the top portion, the bar comprising a first portion configured to slide within the top channel.

6. The shelf system of claim 5 wherein the bar further comprises a pusher, the pusher slideably secured to the bar.

7. The shelf system of claim 1 further comprising a display mount, the display mount secured to the front facing portion of the retail shelf with a step-shaped securing bracket.

8. The shelf system of claim 7 wherein the display mount comprises a front facing area.

9. The shelf system of claim 8 wherein the front facing area is configured to secured printed material.

10. An accessory shelf rail system comprising:

a generally planar top portion having a top side and an opposed lower side;

a lip extending below the lower side of the top portion and defining, together with the lower side of the top portion, a lip channel that is between the lip and the lower side of the top portion and is parallel to the top portion;

a generally planar front portion connected to the top portion, and a lower portion connected to the front portion and angled inwardly;

a rear portion of the top portion comprising a top channel and a lip forming a lip channel, the top channel and the lip channel extending along an entire length of the top portion; and a step-shaped securing bracket comprising a planar upper channel member that is constructed and arranged to fit into and slidably engage in the lip channel in a plane parallel to the top portion, the step-shaped securing bracket configured to removably attach to the retail shelf with a plurality of separate spaced prongs that are constructed and arranged to fit into separate spaced apertures of the generally planar top surface of the retail shelf, to place the upper channel member above the top side of the top surface of the retail shelf.

11. The accessory shelf rail system of claim 10 wherein the step-shaped securing bracket comprises two prongs offset from a flat stabilizing portion, and wherein the flat stabilizing portion is offset from the upper channel member, wherein the bracket further comprises a lower channel member that is configured to sit directly under and engage the top channel.

12. The accessory shelf rail system of claim 11 wherein the flat stabilizing portion is attached to the upper channel member with a hinge.

13. The accessory shelf rail system of claim 10 further comprising a bar positioned ninety degrees from the top portion, the bar comprising a first portion configured to slide within the top channel.

14. The accessory shelf rail system of claim 13 wherein the bar further comprises a pusher, the pusher slideably secured to the bar.

15. A method of providing a retail shelf and an associated display, comprising:

providing a retail shelf, the retail shelf comprising a generally planar top surface having rear facing portion and a front facing portion, the generally planar top surface comprising a series of spaced apertures; and providing an accessory shelf rail system removably secured to the front portion of the retail shelf with at least one step-shaped securing bracket, the accessory shelf rail system comprising a generally planar top portion having a top side and an opposed lower side, a lip extending below the lower side of the top portion and defining, together with the lower side of the top portion, a lip channel that is between the lip and the lower side of the top portion and is parallel to the top portion;

the at least one step-shaped securing bracket comprising a planar upper channel member that is constructed and arranged to fit into and slidably engage in the lip channel in a plane parallel to the top portion, the step-shaped securing bracket configured to removably attach to the retail shelf with a plurality of separate spaced prongs that are constructed and arranged to fit into separate spaced apertures of the generally planar top surface of the retail shelf, to place the upper channel member above the top side of the top surface of the retail shelf.

16. The method of claim 15 wherein the accessory shelf rail system further comprises:

a generally planar front portion connected to the top portion, and a lower portion connected to the front portion and angled inwardly; and a rear portion of the top portion comprising a top channel and a lip forming a lip channel, the top channel and the lip channel extending along an entire length of the top portion.

17. The method of shelf claim 16 wherein the at least one step-shaped securing bracket comprises two prongs offset from a flat stabilizing portion, and wherein the flat stabilizing portion is offset from the upper channel member, wherein the bracket further comprises a lower channel member that is configured to sit directly under and engage the top channel.

18. The method of claim 17 wherein the accessory shelf rail system further comprises a bar positioned ninety degrees from the top portion, the bar comprising a first portion configured to slide within the top channel.

19. The method of claim 18 wherein the bar further comprises a pusher, the pusher slideably secured to the bar.

* * * * *